US007508947B2

(12) United States Patent
Smithers

(10) Patent No.: US 7,508,947 B2
(45) Date of Patent: Mar. 24, 2009

(54) METHOD FOR COMBINING AUDIO SIGNALS USING AUDITORY SCENE ANALYSIS

(75) Inventor: Michael John Smithers, San Mateo, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 277 days.

(21) Appl. No.: 10/911,404

(22) Filed: Aug. 3, 2004

(65) Prior Publication Data

US 2006/0029239 A1 Feb. 9, 2006

(51) Int. Cl.
*H04R 5/00* (2006.01)

(52) U.S. Cl. ..... 381/21; 381/19; 381/20; 381/22; 381/23; 381/17

(58) Field of Classification Search ..... 381/17, 381/119, 19–23
See application file for complete search history.

(56) References Cited

U.S. PATENT DOCUMENTS

| | | | | |
|---|---|---|---|---|
| 4,464,784 | A | 8/1984 | Agnello | |
| 4,624,009 | A | 11/1986 | Glenn et al. | |
| 5,040,081 | A | 8/1991 | McCutchen | |
| 5,235,646 | A | 8/1993 | Wilde et al. | |
| 5,862,228 | A * | 1/1999 | Davis | 381/17 |
| 6,021,386 | A | 2/2000 | Davis et al. | |
| 6,211,919 | B1 | 4/2001 | Zink et al. | |
| 6,430,533 | B1 | 8/2002 | Kolluru et al. | |
| 7,283,954 | B2 | 10/2007 | Crockett et al. | |
| 7,313,519 | B2 | 12/2007 | Crockett | |
| 2001/0027393 | A1 | 10/2001 | Touimi et al. | |
| 2001/0038643 | A1 | 11/2001 | McFarland | |
| 2004/0032960 | A1 * | 2/2004 | Griesinger | 381/104 |
| 2004/0037421 | A1 | 2/2004 | Truman | |
| 2004/0044525 | A1 | 3/2004 | Vinton et al. | |
| 2004/0122662 | A1 | 6/2004 | Crockett | |
| 2004/0133423 | A1 | 7/2004 | Crockett | |
| 2004/0148159 | A1 | 7/2004 | Crockett et al. | |
| 2004/0165730 | A1 * | 8/2004 | Crockett | 381/56 |
| 2004/0172240 | A1 | 9/2004 | Crockett et al. | |
| 2004/0184537 | A1 | 9/2004 | Geiger et al. | |
| 2005/0078840 | A1 | 4/2005 | Riedl | |
| 2005/0157883 | A1 * | 7/2005 | Herre et al. | 381/17 |
| 2006/0002572 | A1 | 1/2006 | Smithers et al. | |
| 2006/0029239 | A1 | 2/2006 | Smithers | |
| 2007/0140499 | A1 | 6/2007 | Davis | |

FOREIGN PATENT DOCUMENTS

| | | |
|---|---|---|
| EP | 0 372 155 A2 | 6/1990 |
| EP | 0 525 544 A2 | 2/1993 |
| JP | 10074097 | 3/1998 |
| WO | WO 91/19989 | 12/1991 |
| WO | WO 91/20164 | 12/1991 |
| WO | WO 98/20482 | 5/1998 |
| WO | WO 99/29114 | 6/1999 |
| WO | WO 00/19414 | 4/2000 |
| WO | WO 00/45378 | 8/2000 |
| WO | WO 02/15587 | 2/2002 |
| WO | WO 02/19768 | 3/2002 |
| WO | WO 02/063925 | 8/2002 |
| WO | WO 02/084645 | 10/2002 |
| WO | WO 02/093560 | 11/2002 |
| WO | WO 02/097790 | 12/2002 |
| WO | WO 02/097791 | 12/2002 |
| WO | WO 02/097792 | 12/2002 |
| WO | WO 03/069954 | 8/2003 |
| WO | WO 03/090208 | 10/2003 |
| WO | WO 03/090208 A | 10/2003 |
| WO | WO 2004/019656 | 3/2004 |
| WO | WO 2004/019656 A | 3/2004 |
| WO | WO 2004/073178 | 8/2004 |
| WO | WO 2004/111994 | 12/2004 |
| WO | WO 2005/086139 | 9/2005 |
| WO | WO/2005/086139 A | 9/2005 |
| WO | WO 2006/006977 | 1/2006 |
| WO | WO 2006/019719 | 2/2006 |
| WO | WO 2006/113047 | 10/2006 |

(Continued)

OTHER PUBLICATIONS

Mitianoudis, et al., "Intelligent Audio Source Separation Using Independent Component Analysis," Audio Engineering Society Convention Paper 5529, presented at the 112th Convention, May 10-13, 2002, Munich, Germany.

(Continued)

*Primary Examiner*—Vivian Chin
*Assistant Examiner*—George C Monikang
(74) *Attorney, Agent, or Firm*—Thomas A. Gallagher; Gallagher & Lathrop

(57) ABSTRACT

A process for combining audio channels combines the audio channels to produce a combined audio channel and dynamically applies one or more of time, phase, and amplitude or power adjustments to the channels, to the combined channel, or to both the channels and the combined channel. One or more of the adjustments are controlled at least in part by a measure of auditory events in one or more of the channels and/or the combined channel. Applications include the presentation of multichannel audio in cinemas and vehicles. Not only methods, but also corresponding computer program implementations and apparatus implementations are included.

18 Claims, 4 Drawing Sheets

FOREIGN PATENT DOCUMENTS

| | | |
|---|---|---|
| WO | WO 2006/113062 | 10/2006 |
| WO | WO 2006/013287 | 12/2006 |
| WO | WO 2006/132857 | 12/2006 |
| WO | WO 2007/016107 | 2/2007 |
| WO | WO 2007/127023 | 11/2007 |

OTHER PUBLICATIONS

U.S. Appl. No. 10/474,387, filed Oct. 7, 2003, Brett Graham Crockett—Jul. 6, 2007 Office Action.
U.S. Appl. No. 10/474,387 , filed Oct. 7, 2003, Brett Graham Crockett—Sep. 20, 2007 Response to Office Action.
PCT/US02/04317, filed Feb. 12, 2002—International Search Report dated Oct. 15, 2002.
Laroche, Jean, "Autocorrelation Method for High-Quality Time/Pitch-Scaling," Telecom Paris, Departement Signal, 75634 Paris Cedex 13. France, email: laroche@sig.enst.fr.
Australian Patent Office—Feb. 19, 2007—Examiner's first report on application No. 2002248431.
Chinese Patent Office—Apr. 22, 2005—Notification of First Office Action for Application No. 02808144.7.
Chinese Patent Office—Dec. 9, 2005—Notification of Second Office Action for Application No. 02808144.7.
Malaysian Patent Office—Apr. 7, 2006—Substantive Examination Adverse Report—Section 30(1) / 30(2)) for Application No. PI 20021371.
U.S. Appl. No. 10/476,347, filed Oct. 28, 2003, Brett Graham Crockett—Feb. 12, 2007 Office Action.
U.S. Appl. No. 10/476,347, filed Oct. 28, 2003, Brett Graham Crockett—May 14, 2007 Response to Office Action.
PCT/US02/12957, filed Apr. 25, 2002—International Search Report dated Aug. 12, 2002.
Vanfin, et al., "Modifying Transients for Efficient Coding of Audio," IEEE, pp. 3285-3288, Apr. 2001.
Vanfin, et al., "Improved Modeling of Audio Signals by Modifying Transient Locations," pp. W2001-W2001-4, Oct. 21-24, 2001, New Paltz, New York.
Australian Patent Office—Feb. 26, 2007—Examiner's first report on application No. 2002307533.
Chinese Patent Office—May 13, 2005—Notification of First Office Action for Application No. 02809542.1.
Chinese Patent Office—Feb. 17, 2006—Notification of Second Office Action for Application No. 02809542.1.
European Patent Office—Dec. 19, 2005—Communication Pursuant to Article 96(2) for EP Application No. 02 769 666.5—2218.
Indian Patent Office—Jan. 3, 2007—First Examination Report for Application No. 1308/KOLNP/2003—J.
U.S. Appl. No. 10/478,397, filed Nov. 20, 2003, Brett G. Crockett—Feb. 27, 2007 Office Action.
U.S. Appl. No. 10/478,397, filed Nov. 20, 2003, Brett G. Crockett—May 29, 2007 Response to Office Action.
PCT/US02/05329, filed Feb. 22, 2002—International Search Report dated Oct. 7, 2002.
Edmonds, et al., "Automatic Feature Extraction from Spectrograms for Acoustic-Phonetic Analysis," pp. 701-704, Lutchi Research Center, Loughborough University of Technology, Loughborough, U.K.
Chinese Patent Office—Mar. 10, 2006—Notification of the First Office Action for Application No. 02810670.9.
U.S. Appl. No. 10/478,398, filed Nov. 20, 2003, Brett G. Crockett—Feb. 27, 2007 Office Action.
U.S. Appl. No. 10/478,398, filed Nov. 20, 2003, Brett G. Crockett—May 29, 2007 Response to Office Action.
U.S. Appl. No. 10/478,398, filed Nov. 20, 2003, Brett G. Crockett—Jul. 20, 2007 Office Action.
U.S. Appl. No. 10/478,398, filed Nov. 30, 2003, Brett G. Crockett—Oct. 19, 2007 Request for Continued Examination with attached IDS.
U.S. Appl. No. 10/478,398, filed Nov. 20, 2003, Brett G. Crockett—Jan. 30, 2008 Office Action.
PCT/US02/05806, filed Feb. 25, 2002—International Search Report dated Oct. 7, 2002.
Chinese Patent Office—Nov. 5, 2004—Notification of First Office Action for Application No. 02810672.5.
Chinese Patent Office—Aug. 26, 2005—Notification of Second Office Action for Application No. 02810672.5.
European Patent Office—Aug. 10, 2004—Communication pursuant to Article 96(2) EPC for Application No. 02 707896.3—1247.
European Patent Office—Dec. 16, 2005—Communication pursuant to Article 96(2) EPC for Application No. 02 707 896.3—1247.
Indian Patent Office—Oct. 10, 2006—First Examination Report for Application No. 01490/KOLNP/2003.
Indian Patent Office—May 29, 2007—Letter for Application No. 01490/KOLNP/2003.
Indian Patent Office—Aug. 10, 2007—Letter for Application No. 01490/KOLNP/2003.
Japanese Patent Office—Partial Translation of Office Action received Oct. 5, 2007.
U.S. Appl. No. 10/478,538, filed Nov. 20, 2003, Brett G. Crockett—Aug. 24, 2006 Office Action.
U.S. Appl. No. 10/478,538, filed Nov. 20, 2003, Brett G. Crockett—Nov. 24, 2006 Response to Office Action.
U.S. Appl. No. 10/478,538, filed Nov. 20, 2003, Brett G. Crockett—Feb. 23, 2007 Office Action.
U.S. Appl. No. 10/478,538, filed Nov. 20, 2003, Brett G. Crockett—Jun. 25, 2007 Response to Office Action.
U.S. Appl. No. 10/478,538, filed Nov. 20, 2003, Brett G. Crockett—Sep. 10, 2007 Office Action.
U.S. Appl. No. 10/478,538, filed Nov. 20, 2003, Brett G Crockett—Jan. 9, 2008—Response to Office Action.
PCT/US02/05999, filed Feb. 26, 2002—International Search Report dated Oct. 7, 2002.
Fishbach, Alon, Primary Segmentation of Auditory Scenes, IEEE, pp. 113-117, 1994.
Australian Patent Office—Mar. 9, 2007—Examiner's first report on application No. 2002252143.
Chinese Patent Office—Dec. 31, 2004—Notification of the First Office Action for Application No. 02810671.7.
Chinese Patent Office—Jul. 15, 2005—Notification of Second Office Action for Application No. 02810671.7.
Chinese Patent Office—Apr. 28, 2006—Notification of Third Office Action for Application No. 02810671.7.
Indian Patent Office—Nov. 23, 2006 First Examination Report for Application No. 01487/KOLNP/2003—G.
Indian Patent Office—Jul. 30, 2007 (Aug. 2, 2007) Letter from the Indian Patent Office for Application No. 01487/KOLNP/2003—G.
U.S. Appl. No. 10/591,374, filed Aug. 31, 2006, Mark Franklin Davis—Pending claims in application.
PCT/US2005/006359, filed Feb. 28, 2005—International Search Report and Written Opinion dated Jun. 6, 2005.
ATSC Standard: Digital Audio Compression (AC-3), Revision A, Doc A/52A, ATSC Standard, Aug. 20, 2001, pp. 1-140.
Schuijers, E., et al.; "Advances in Parametric Coding for High-Quality Audio," Preprints of Papers Presented at the AES Convention, Mar. 22, 2003, pp. 1-11, Amsterdam, The Netherlands.
European Patent Office—Sep. 28, 2007—Examination Report for Application No. 05 724 000.4—2225.
European Patent Office—Jan. 26, 2007—Communication pursuant to Article 96(2) EPC for Application No. 05 724 000.4—2218.
SG 200605858-0 Singapore Patent Office Written Opinion dated Oct. 17, 2007 based on PCT Application filed Feb. 28, 2005.
PCT/US2005/024630, filed Jul. 13, 2005—International Search Report and Written Opinion dated Dec. 1, 2005.
U.S. Appl. No. 11/999,159 filed Dec. 3, 2007, Alan Jeffrey Seefeldt, et al.—Pending claims in application.
PCT/US2006/020882, filed May 26, 2006—International Search Report and Written Opinion dated Feb. 20, 2007.
Faller, Christof, "Coding of Spatial Audio Compatible with Different Playback Formats," Audio Engineering Society Convention Paper, presented at the 117th Convention, pp. 1-12, Oct. 28-31, 2004, San Francisco, CA.
Herre, et al., "MP3 Surround: Efficient and Compatible Coding of Multi-Channel Audio," Audio Engineering Society Convention Paper, presented at the 116th Convention, pp. 1-14, May 8-11, 2004, Berlin, Germany.

Fielder, et al., "Introduction to Dolby Digital Plus, an Enhancement to the Dolby Digital Coding System," Audio Engineering Society Convention Paper, presented at the 117th Convention, pp. 1-29, Oct. 28-31, 2004, San Francisco, CA.
Herre, et al., "Spatial Audio Coding: Next-Generation Efficient and Compatible Coding of Multi-Channel Audio," Audio Engineering Society Convention Paper, presented at the 117th Convention, pp. 1-13, Oct. 28-31, 2004, San Francisco, CA.
Faller, Christof, "Parametric Coding of Spatial Audio," These No. 3062, pp. 1-164, (2004) Lausanne, EPFL.
Herre, et al., "The Reference Model Architecture for MPEG Spatial Audio Coding," Audio Engineering Society Convention Paper, presented at the 118th Convention, pp. 1-13, May 28-31, 2005, Barcelona, Spain.
Schuijers, et al., "Low Complexity Parametric Stereo Coding," Audio Engineering Society Convention Paper, presented at the 116th Convention, pp. 1-11, May 8-11, 2004, Berlin, Germany.
PCT/US2006/028874, filed Jul. 24, 2006—Alan Jeffrey Seefeldt and Mark Stuart Vinton—Pending claims in application.
PCT/US2007/008313, filed Mar. 30, 2007—International Search Report and Written Opinion dated Sep. 21, 2007.
Blesser, B., "An Ultraminiature Console Compression System with Maximum User Flexibility," presented Oct. 8, 1971 at the 41st Convention of the Audio Engineering Society, New York, AES May 1972 vol. 20, No. 4, pp. 297-302.
Hoeg, W., et al., "Dynamic Range Control (DRC) and Music/Speech Control (MSC) Programme-Associated Data Services for DAB," EBU Review—Technical, European Broadcasting Union. Brussels, BE, No. 261, Sep. 21, 1994, pp. 56-70.
Brandenburg, K., "MP3 and AAC Explained," Proceedings of the International AES Conference, 1999, pp. 99-110.
Carroll, Tim, "Audio Metadata: You Can Get There from Here," Oct. 11, 2004, pp. 1-4, Retrieved from the Internet: URL:http://tvtechnology.com/features/audio_notes/f-TC-metadta-8.21.02.shtml.
Painter, T., et al., "Perceptual Coding of Digital Audio", Proceedings of the IEEE, New York, NY, vol. 88, No. 4, Apr. 2000, pp. 451-513.
Swanson, M. D., et al., "Multiresolution Video Watermarking Using Perceptual Models and Scene Segmentation," Proceedings of the International Conference on Image Processing, Santa Barbara, Ca, Oct. 26-29, 1997, Los Alamitos, CA IEEE Computer Society, US, vol. 2, Oct. 1997, pp. 558-561.
Todd, et al., "AC-3: Flexible Perceptual Coding for Audio Transmission and Storage," 96th Convention of the Audio Engineering Society, Preprint 3796, Feb. 1994, pp. 1-16.
Smith, et al., "Tandem-Free VoIP Conferencing: A Bridge to Next-Generation Networks," IEEE Communications Magazine, May 2003, pp. 136-145.
Riedmiller Jeffrey C., "Solving TV Loudness Problems Can You 'Accurately' Hear the Difference," Communications Technology, Feb. 2004.
Moore, B. C. J., et al., "A Model for the Prediction of Thresholds, Loudness and Partial Loudness," Journal of the Audio Engineering Society, New York, NY vol. 45, No. 4, Apr. 1, 1997, pp. 224-240.
Glasberg, B. R., et al., "A Model of Loudness Applicable to Time-Varying Sounds," Audio Engineering Society, New York, NY, vol. 50, No. 5, May 2002, pp. 331-342.
Hauenstein, M., "A Computationally Efficient Algorithm for Calculating Loudness Patterns of Narrowband Speech," Acoustics, Speech and Signal Processing, 1997, IEEE International Conference, Munich, Germany, Apr. 21-24, 1997, Los Alamitos, CA USE, IEEE Comput. Soc. US Apr. 21, 1997, pp. 1311-1314.
Trappe, W., et al., "Key Distribution fro Secure Multimedia Multicasts via Data Embedding," 2001 IEEE International Conferences on Acoustics, Speech and Signal Processing Proceedings, Salt Lake City UT, May 7-11, 2001 IEEE International Conference on Acoustics, Speech and Signal Processing, New York, NY, IEEE, US, vol. 1 of 6, May 7, 2001, pp. 1449-1452.
Foti, Frank, "DTV Audio Processing: Exploring the New Frontier," OMNIA, Nov. 1998, pp. 1-3.
Crockett, et al., "A Method for Characterizing and Identifying Audio Based on Auditory Scene Analysis," AES Convention Paper 6416, presented at the 118th Convention May 28-31, 2005, Barcelona, Spain.

* cited by examiner

Content Channels

Playback Channels

METHOD FOR COMBINING AUDIO SIGNALS USING AUDITORY SCENE ANALYSIS

CROSS-REFERENCES TO RELATED APPLICATIONS AND PATENTS

The present application is related to U.S. Non-Provisional patent application Ser. No. 10/474,387, entitled "High Quality Time-Scaling and Pitch-Scaling of Audio Signals," by Brett Graham Crockett, filed Oct. 7, 2003, published as US 2004/0122662 on Jun. 24, 2004,. The PCT counterpart application was published as WO 02/084645 A2 on Oct. 24, 2002.

The present application is also related to U.S. Non-Provisional patent application Ser. No. 10/476,347, entitled "Improving Transient Performance of Low Bit Rate Audio Coding Systems by Reducing Pre-Noise," by Brett Graham Crockett, filed Oct. 28, 2003, published as US 2004/0133423 on Jul. 8, 2004, now U.S. Pat. No. 7,313,519. The PCT counterpart application was published as WO 02/093560 on Nov. 21, 2002.

The present application is also related to U.S. Non-Provisional patent application Ser. No. 10/478,397, entitled "Comparing Audio Using Characterizations Based on Auditory Events," by Brett Graham Crockett and Michael John Smithers, filed Nov. 20, 2003, published as 2004/0172240 on Sep. 2, 2004, now U.S. Pat. No. 7,283,954. The PCT counterpart application was published as WO 02/097790 on Dec. 5, 2002.

The present application is also related to U.S. Non-Provisional patent application Ser. No. 10/474,398, entitled "Method for Time Aligning Audio Signals using Characterizations Based on Auditory Events," by Brett Graham Crockett and Michael John Smithers, filed Nov. 20, 2003, published as US 2004-0148159 on Jul. 29, 2004. The PCT counterpart application was published as WO 02/097791 on Dec. 5, 2002.

The present application is also related to U.S. Non-Provisional patent application Ser. No. 10/478,538, entitled "Segmenting Audio Signals into Auditory Events," by Brett Graham Crockett, filed Nov. 20, 2003, published as US 2004/0165730 on Aug. 26, 2004. The PCT counterpart application was published as WO 02/097792 on Dec. 5, 2002.

The present application is also related to U.S. Non-Provisional patent application Ser. No. 10/591,374, entitled "Multichannel Audio Coding," by Mark Franklin Davis, filed Aug. 31, 2006, published as US/2007/0140499 on Jun. 21, 2007. The PCT counterpart application was published as WO 05/086139 on Sep. 15, 2005.

The present application is also related to U.S. Non-Provisional patent application Ser. NO. 11/999,159, entitled "Channel Reconfiguration with Side Information," by Alan Jeffrey Seefeldt, Mark Stuart Vinton and Charles Quito Robinson, filed Dec. 3, 2007. The PCT counterpart application was published as WO 2006/0132857 on Dec. 14, 2006.

The present application is also related to PCT Application (designating the U.S.) S.N. PCT/2006/028874, entitled "Controlling Spatial Audio Coding Parameters as a Function of Auditory Events," by Alan Jeffrey Seefeldt and Mark Stuart Vinton. filed Jul. 24, 2006. The PCT counterpart application was published as WO 07/016107 on Feb. 8, 2007.

The present application is also related to PCT Application (designating the U.S.), S.N. PCT/2007/008313, entitled "Audio Gain Control Using Specific-Loudness-Based Auditory Event Detection," by Brett Graham Crockett and Alan Jeffrey Seefeldt. filed Mar. 30, 2007. The PCT counterpart application was published as WO 2007/127023 on Nov. 8, 2007.

TECHNICAL FIELD

The present invention is related to changing the number of channels in a multichannel audio signal in which some of the audio channels are combined. Applications include the presentation of multichannel audio in cinemas and vehicles. The invention includes not only methods but also corresponding computer program implementations and apparatus implementations.

BACKGROUND

In the last few decades, there has been an ever-increasing rise in the production, distribution and presentation of multichannel audio material. This rise has been driven significantly by the film industry in which 5.1 channel playback systems are almost ubiquitous and, more recently, by the music industry which is beginning to produce 5.1 multichannel music.

Typically, such audio material is presented through a playback system that has the same number of channels as the material. For example, a 5.1 channel film soundtrack may be presented in a 5.1 channel cinema or through a 5.1 channel home theater audio system. However, there is an increasing desire to play multichannel material over systems or in environments that do not have the same number of presentation channels as the number of channels in the audio material—for example, the playback of 5.1 channel material in a vehicle that has only two or four playback channels, or the playback of greater than 5.1 channel movie soundtracks in a cinema that is only equipped with a 5.1 channel system. In such situations, there is a need to combine or "downmix" some or all of the channels of the multichannel signal for presentation.

The combining of channels may produce audible artifacts. For example, some frequency components may cancel while other frequency components reinforce or become louder. Most commonly, this is a result of the existence of similar or correlated audio signal components in two or more of the channels that are being combined.

It is an object of this invention to minimize or suppress artifacts that occur as a result of combining channels. Other objects will be appreciated as this document is read and understood.

It should be noted that the combining of channels may be required for other purposes, not just for a reduction in the number of channels. For example, there may be a need to create an additional playback channel that is some combination of two or more of the original channels in the multichannel signal. This may be characterized as a type of "upmixing" in that the result is more than the original number of channels. Thus, whether in the context of "downmixing" or "upmixing," the combining of channels to create an additional channel may lead to audible artifacts.

Common techniques for minimizing mixing or channel-combining artifacts involve applying, for example, one or more of time, phase, and amplitude (or power) adjustments to the channels to be combined, to the resulting combined channel, or to both. Audio signals are inherently dynamic—that is, their characteristics change over time. Therefore, such adjustments to audio signals are typically calculated and applied in a dynamic manner. While removing some artifacts resulting from combining, such dynamic processing may introduce other artifacts. To minimize such dynamic processing artifacts, the present invention employs Auditory Scene Analysis so that, in general, dynamic processing adjustments are maintained substantially constant during auditory scenes or events and changes in such adjustments are permitted only at or near auditory scene or event boundaries.

Auditory Scene Analysis

The division of sounds into units perceived as separate is sometimes referred to as "auditory event analysis" or "auditory scene analysis" ("ASA"). An extensive discussion of auditory scene analysis is set forth by Albert S. Bregman in his book *Auditory Scene Analysis—The Perceptual Organization of Sound*, Massachusetts Institute of Technology, 1991, Fourth printing, 2001, Second MIT Press paperback edition.

Techniques for identifying auditory events (including event boundaries) in accordance with aspects of Auditory Scene Analysis are set forth in U.S. patent application Ser. No. 10/478,538 of Brett G. Crockett, filed Nov. 20, 2003, entitled "Segmenting Audio Signals into Auditory Events," which is the U.S. National application resulting from International Application PCT/US02/05999, filed Feb. 2, 2002, designating the United States, published as WO 02/097792 on Dec. 5, 2002. Said applications are hereby incorporated by reference in their entirety. Certain applications of the auditory event identification techniques of said Crockett applications are set forth in U.S. patent application Ser. No. 10/478,397 of Brett G. Crockett and Michael J. Smithers, filed Nov. 20, 2003, entitled "Comparing Audio Using Characterizations Based on Auditory Events,", which is a U.S. National application resulting from International Application PCT/US02/05329, filed Feb. 22, 2002, designating the United States, published as WO 02/097790 on Dec. 5, 2002, and U.S. patent application Ser. No. 10/478,398 of Brett G. Crockett and Michael J. Smithers, filed Nov. 20, 2003, entitled "Method for Time Aligning Audio Signals Using Characterizations Based on Auditory Events," published Jul. 29, 2004 as US 2004/0148159 A1, which is a U.S. National application resulting from International Application PCT/US02/05806, filed Feb. 25, 2002, designating the United States, published as WO 02/097791 on Dec. 5, 2002. Each of said Crockett and Smithers applications are also hereby incorporated by reference in their entirety.

Although techniques described in said Crockett and Crockett/Smithers applications are particularly useful in connection with aspects of the present invention, other techniques for identifying auditory events and event boundaries may be employed in aspects of the present invention.

SUMMARY OF THE INVENTION

According to an aspect of the invention, a process for combining audio channels, comprises combining the audio channels to produce a combined audio channel, and dynamically applying one or more of time, phase, and amplitude or power adjustments to the channels, to the combined channel, or to both the channels and the combined channel, wherein one or more of said adjustments are controlled at least in part by a measure of auditory events in one or more of the channels and/or the combined channel. The adjustments may be controlled so as to remain substantially constant during auditory events and to permit changes at or near auditory event boundaries.

The main goal of the invention is to improve the sound quality of combined audio signals. This may be achieved, for example, by performing, variously, time, phase and/or amplitude (or power) correction to the audio signals, and by controlling such corrections at least in part with a measure of auditory scene analysis information. In accordance with aspects of the present invention, adjustments applied to the audio signals generally may be held relatively constant during an auditory event and allowed to change at or near boundaries or transitions between auditory events. Of course, such adjustments need not occur as frequently as every boundary. The control of such adjustments may be accomplished on a channel-by-channel basis in response to auditory event information in each channel. Alternatively, some or all of such adjustments may be accomplished in response to auditory event information that has been combined over all channels or fewer than all channels.

Other aspects of the present invention include apparatus or devices for performing the above-described processes and other processes described in the present application along with computer program implementations of such processes. Yet further aspects of the invention may be appreciated as this document is read and understood.

BRIEF DESCRIPTION OF THE DRAWINGS

FIG. 7*a* shows the approximate spatial locations of the "content" channels of a multichannel audio signal, while FIG. 7*b* shows the approximate spatial locations of "playback" in a cinema equipped to play five-channel audio material.

MODES FOR CARRYING OUT THE INVENTION

Figure 1:
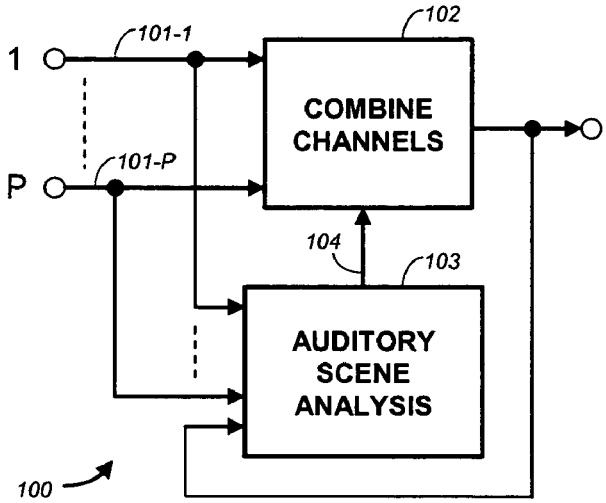
FIG. 1 is a functional schematic block diagram of a generalized embodiment of the present invention.

A generalized embodiment of the present invention is shown in FIG. 1, wherein an audio channel combiner or combining process 100 is shown. A plurality of audio input channels, P input channels, 101-1 through 101-P are applied to a channel combiner or combining function ("Combine Channels") 102 and to an auditory scene analyzer or analysis function ("Auditory Scene Analysis") 103. There may be two or more input channels to be combined. Channels 1 through P may constitute some or all of a set of input channels. Combine Channels 102 combines the channels applied to it. Although such combination may be, for example, a linear, additive combining, the combination technique is not critical to the present invention. In addition to combining the channels applied to it, Combine Channels 102 also dynamically applies one or more of time, phase, and amplitude or power adjustments to the channels to be combined, to the resulting combined channel, or to both the channels to be combined and the resulting combined channel. Such adjustments may be made for the purpose of improving the quality of the channel combining by reducing mixing or channel-combining artifacts. The particular adjustment techniques are not critical to the present invention. Examples of suitable techniques for combining and adjusting are set forth in U.S. Provisional Patent Application Ser. No. 60/549,368 of Mark Franklin Davis, filed Mar. 1, 2004, entitled "Low Bit Rate Audio Encoding and Decoding in Which Multiple Channels Are Represented by a Monophonic Channel and Auxiliary Information,", U.S. Provisional Application Ser. No. 60/579,974 of Mark Franklin Davis, et al, filed Jun. 14, 2004, entitled "Low Bit Rate Audio Encoding and Decoding in which Multiple Channels are Represented by a Monophonic Channel and Auxiliary Information,", and U.S. Provisional Application Ser. No. 60/588,256, of Mark Franklin Davis, et al filed Jul. 14, 2004, entitled Low Bit Rate Audio Encoding and Decoding in which Multiple Channels are Represented by a Monophonic Channel and Auxiliary Information,". Each of said three provisional applications of Davis and Davis, et al are hereby incorporated by reference in their entirety. Auditory Scene Analysis 103 derives auditory scene information in accordance, for example, with techniques described in one or more of the above-identified applications by or some other suitable auditory scene analyzer or analysis process. Such information 104, which should include at least the location of boundaries between auditory events, is applied to Combine Channels 102. One or more of said adjustments are controlled at least in part by a measure of auditory events in one or more of the channels to be combined and/or the resulting combined channel.

Figure 2:
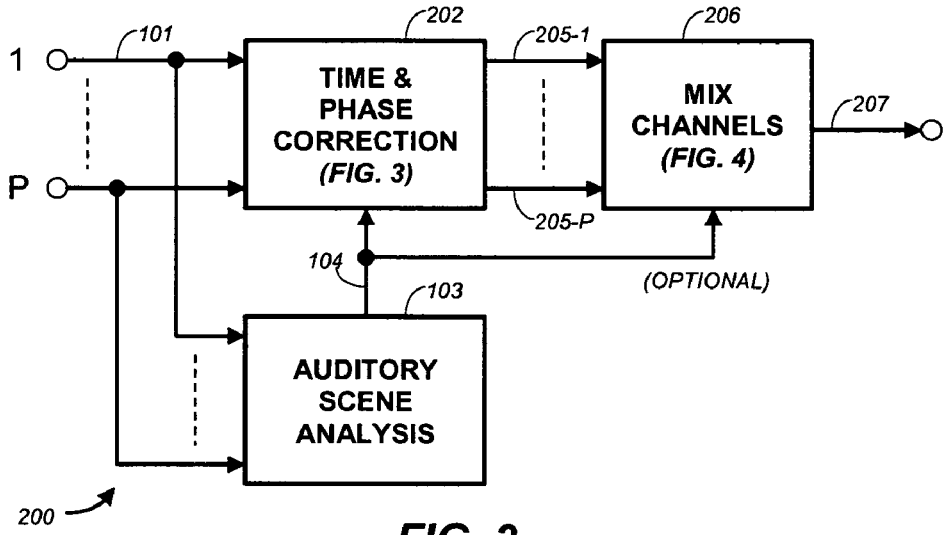
FIG. 2 is a functional schematic block diagram of an audio signal process or processing method embodying aspects of the present invention.

FIG. 2 shows an example of an audio signal processor or processing method 200 embodying aspects of the present invention. Signals 101-1 through 101-P from a plurality of audio channels 1 through P that are to be combined are applied to a time and/or phase correction device or process ("Time & Phase Correction") 202 and to an auditory scene analysis device or process ("Auditory Scene Analysis") 103, as described in connection with FIG. 1. Channels 1 through P may constitute some or all of a set of input channels. Auditory Scene Analysis 103 derives auditory scene information 104 and applies it to the Time & Phase Correction 202, which applies time and/or phase correction individually to each of the channels to be combined, as is described below in connection with FIG. 3. The corrected channels 205-1 through 205-P are then applied to a channel mixing device or process ("Mix Channels") 206 that combines the channels to create a single output channel 207. Optionally, Mix Channels 206 may also be controlled by the Auditory Scene Analysis information 104, as is described further below. An audio signal processor or processing method embodying aspects of the present invention as in the examples of FIGS. 1 and 2 may also combine various ones of channels 1 through P to produce more than one output channel.

Auditory Scene Analysis 103 (FIGS. 1 and 2)

Auditory scene analysis research has shown that the ear uses several different auditory cues to identify the beginning and end of a perceived auditory event. As taught in the above-identified applications, one of the most powerful cues is a change in the spectral content of the audio signal. For each input channel, Auditory Scene Analysis 103 performs spectral analysis on the audio of each channel 1 through P at defined time intervals to create a sequence of frequency representations of the signal. In the manner described in said above-identified applications, successive representations may be compared in order to find a change in spectral content greater than a threshold. Finding such a change indicates an auditory event boundary between that pair of successive frequency representations, denoting approximately the end of one auditory event and the start of another. The locations of the auditory event boundaries for each input channel are output as components of the Auditory Scene Analysis information 104. Although this may be accomplished in the manner described in said above-identified applications, auditory events and their boundaries may be detected by other suitable techniques.

Auditory events are perceived units of sound with characteristics that remain substantially constant throughout the event. If time, phase and/or amplitude (or power) adjustments, such as may be used in embodiments of the present invention, vary significantly within an auditory event, effects of such adjustments may become audible, constituting undesirable artifacts. By keeping adjustments constant throughout an event and only changing the adjustments sufficiently close to event boundaries, the similarity of an auditory event is not broken up and the changes are likely to be hidden among more noticeable changes in the audio content that inherently signify the event boundary.

Ideally, in accordance with aspects of the present invention, channel combining or "downmixing" parameters should be allowed to change only at auditory event boundaries, so that no dynamic changes occur within an event. However, practical systems for detecting auditory events typically operate in the digital domain in which blocks of digital audio samples in the time-domain are transformed into the frequency domain such that the time resolution of the auditory event boundaries have a fairly coarse time resolution, which resolution is related to the block length of the digital audio samples. If that resolution is chosen (with a trade-off between block length and frequency resolution) to yield useful approximations to the actual event boundaries, that is to say, if the resolution yields approximate boundaries that are close enough so that the errors are not perceptible to a listener, then for the purposes of dynamic downmixing in accordance with the present invention, it is adequate to use not the actual boundaries, which are unknown, but rather the approximations provided by block boundaries. Thus, in accordance with an example in the above-identified applications of Crockett, event boundaries may be determined to within half a block length, or about 5.8 milliseconds for the example of a 512 sample block length in a system employing a 44.1 kHz sampling rate.

In a practical implementation of aspects of the present invention, each input channel is a discrete time-domain audio signal. This discrete signal may be partitioned into overlapping blocks of approximately 10.6 milliseconds, in which the overlap is approximately 5.3 milliseconds. For an audio sample rate of 48 kHz, this is equivalent to 512 sample blocks of which 256 samples overlaps with the previous block. Each block may be windowed using, for example, a Hanning window and transformed into the frequency domain using, for example, a Discrete Fourier Transform (implemented as a Fast Fourier Transform for speed). The power, in units of decibels (dB), is calculated for each spectral value and then the spectrum is normalized to the largest dB spectral value. Non-overlapping or partially overlapping blocks may be used to reduce the cost of computation. Also, other window functions may be used, however the Hanning window has been found to be well suited to this application.

As described in the above-cited applications of Crockett, the normalized frequency spectrum for a current block may be compared to the normalized spectrum from the next previous block to obtain a measure of their difference. Specifically, a single difference measure may be calculated by summing the absolute value of the difference in the dB spectral values of the current and next previous spectrums. Such difference measure may then be compared to a threshold. If the difference measure is greater than the threshold, an event boundary is indicated between the current and previous block, otherwise no event boundary is indicated between the current and previous block. A suitable value for this threshold has been found to be 2500 (in units of dB). Thus, event boundaries may be determined within an accuracy of about half a block.

This threshold approach could be applied to frequency subbands in which each subband has a distinct difference measure. However, in the context of the present invention, a single measure based on full bandwidth audio is sufficient in view of the perceived human ability to focus on one event at any moment in time. The auditory event boundary information for each channel 1 through P is output as a component of the Auditory Scene Analysis information 104.

Time & Phase Correction 202 (FIG. 2)

Figure 3:
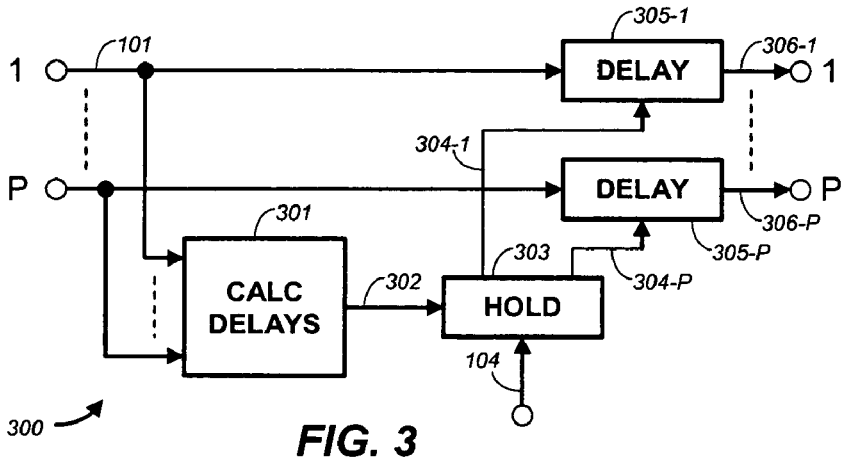
FIG. 3 is a functional schematic block diagram showing the Time and Phase Correction 202 of FIG. 2 in more detail.
Figure 5A:
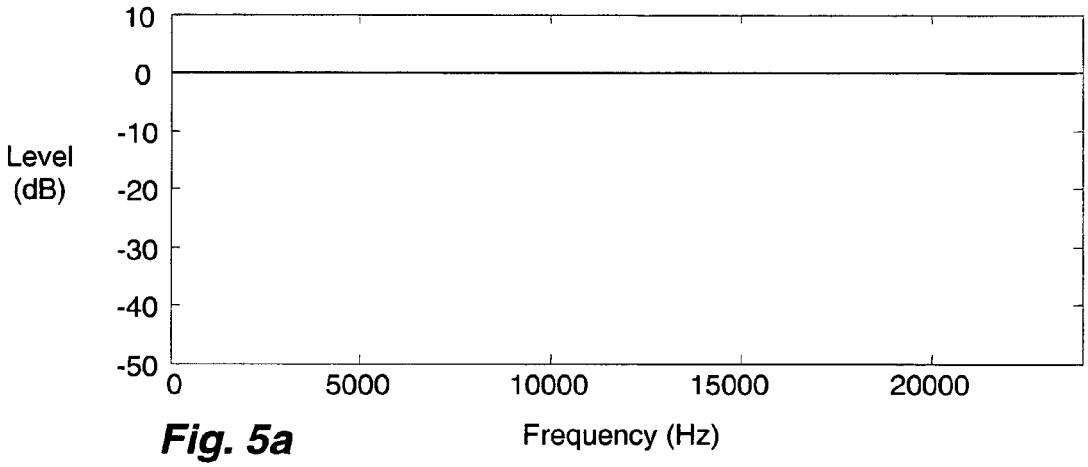
FIG. 5*a* is an idealized response showing the magnitude spectrum of a white noise signal.
Figure 5B:
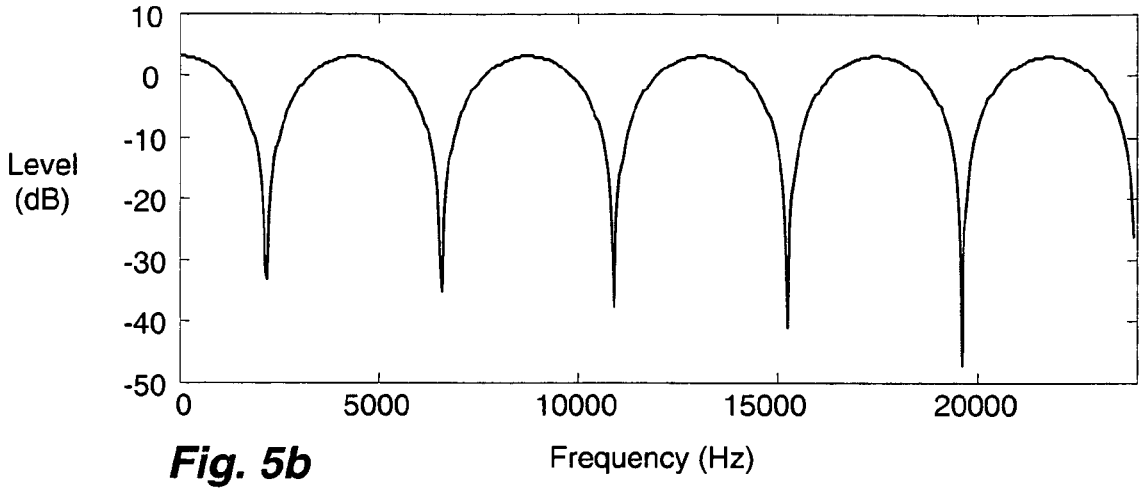
FIG. 5*b* is an idealized response showing the magnitude spectrum resulting from the simple combining of a first channel consisting of white noise with a second signal that is the same white noise signal but delayed in time by approximately a fraction of a millisecond. In both FIGS. 5*a* and 5*b*, the horizontal axis is frequency in Hz and the vertical axis is a relative level in decibels (dB).

Time and Phase Correction 202 looks for high correlation and time or phase differences between pairs of the input channels. FIG. 3 shows the Time and Phase Correction 202 in more detail. As explained below, one channel of each pair is a reference channel. One suitable correlation detection technique is described below. Other suitable correlation detection techniques may be employed. When a high correlation exists between a non-reference channel and a reference channel, the device or process attempts to reduce phase or time differences between the pair of channels by modifying the phase or time characteristics of the non-reference channel, thus reducing or eliminating audible channel-combining artifacts that would otherwise result from the combining of that pair of channels. Some of such artifacts may be described by way of an example. FIG. 5*a* shows the magnitude spectrum of a white noise signal. FIG. 5*b* shows the magnitude spectrum resulting from the simple combining of a first channel consisting of white noise with a second signal that is the same white noise signal but delayed in time by approximately 0.21 milliseconds. A combination of the undelayed and delayed versions of the white noise signal has cancellations and spectral shaping, commonly called comb filtering, and audibly sounds very different to the white noise of each input signal.

FIG. 3 shows a suitable device or method 300 for removing phase or time delays. Signals 101-1 through 101-P from each input audio channel are applied to a delay calculating device or process ("Calc Delays") 301 that outputs a delay-indicating signal 302 for each channel. The auditory event boundary information 104, which may have a component for each channel 1 through P, is used by a device or process that includes a temporary memory device or process ("Hold") 303 to conditionally update delay signals 304-1 through 304-P that are used, respectively, by delay devices or functions ("Delay") 305-1 through 305-P for each channel to produce output channels 306-1 through 306-P.

Calc Delays 301 (FIG. 3)

Calc Delays 301 measures the relative delay between pairs of the input channels. A preferred method is, first, to select a reference channel from among the input channels. This reference may be fixed or it may vary over time. Allowing the reference channel to vary, overcomes the problem, for example, of a silent reference channel. If the reference channel varies, it may be determined, for example, by the channel loudness (e.g., loudest is the reference). As mentioned above, the input audio signals for each input channel may be divided into overlapping blocks of approximately 10.6 milliseconds in length, overlapping by approximately 5.3 milliseconds. For an audio sample rate of 48 kHz, this is equivalent to 512 sample blocks of which 256 samples overlaps with the previous block.

The delay between each non-reference channel and the reference channel may be calculated using any suitable cross-correlation method. For example, let $S_1$ (length $N_1$) be a block of samples from the reference channel and $S_2$ (length $N_2$) a block of samples from one of the non-reference channels. First calculate the cross-correlation array $R_{1,2}$.

$$R_{1,2}(l) = \sum_{n=-\infty}^{\infty} S_1(n) \cdot S_2(n-l) \quad l = 0, \pm 1, \pm 2, \ldots \tag{1}$$

The cross-correlation may be performed using standard FFT based techniques to reduce execution time. Since both $S_1$ and $S_2$ are finite in length, the non-zero component of $R_{1,2}$ has a length of $N_1+N_2-1$. The lag l corresponding to the maximum element in $R_{1,2}$ represents the delay of $S_2$ relative to $S_1$.

$$l_{peak} = l \text{ for } \mathrm{MAX}[R_{1,2}(l)] \tag{2}$$

This lag or delay has the same sample units as the arrays $S_1$ and $S_2$.

The cross-correlation result for the current block is time smoothed with the cross-correlation result from the previous block using a first order infinite impulse response filter to create the smoothed cross-correlation $Q_{1,2}$. The following equation shows the filter computation where m denotes the current block and m-1 denotes the previous block.

$$Q_{1,2}(l,m) = \alpha \times R_{1,2}(l) + (1-\alpha) \times Q_{1,2}(l,m-1) \quad l = 0, \pm 1, \pm 2, \tag{3}$$

A useful value for $\alpha$ has been found to be 0.1. As for the cross-correlation $R_{1,2}$, the lag l corresponding to the maximum element in $Q_{1,2}$ represents the delay of $S_2$ relative to $S_1$. The lag or delay for each non-reference channel is output as a signal component of signal 302. A value of zero may also output as a component of signal 302, representing the delay of the reference channel.

The range of delay that can be measured is proportional to the audio signal block size. That is, the larger the block size, the larger the range of delays that can be measured using this method.

Hold 303 (FIG. 3)

When an event boundary is indicated via ASA information 104 for a channel, Hold 303 copies the delay value for that channel from 302 to the corresponding output channel delay signal 304. When no event boundary is indicated, Hold 303 maintains the last delay value 304. In this way, time alignment changes occur at event boundaries and are therefore less likely to lead to audible artifacts.

Delay 305-1 through 305-P (FIG. 3)

Since the delay signal 304 can be either positive or negative, each of the Delays 305-1 through 305-P by default may be implemented to delay each channel by the absolute maximum delay that can be calculated by Calc Delays 301. Therefore, the total sample delay in each of the Delays 305-1 through 305-P is the sum of the respective input delay signal

304-1 through 304-P plus the default amount of delay. This allows for the signals 302 and 304 to be positive or negative, wherein negative indicates that a channel is advanced in time relative to the reference channel.

When any of the input delay signals 304-1 through 304-P change value, it may be necessary either to remove or replicate samples. Preferably, this is performed in a manner that does not cause audible artifacts. Such methods may include overlapping and crossfading samples. Alternatively, because the output signals 306-1 to 306-P may be applied to a filterbank (see FIG. 4), it may be useful to combine the delay and filterbank such that the delay controls the alignment of the samples that are applied to the filterbank.

Alternatively, a more complex method may measure and correct for time or phase differences in individual frequency bands or groups of frequency bands. In such a more complex method, both Calc Delays 301 and Delays 305-1 through 305-P may operate in the frequency domain, in which case Delays 305-1 through 305-P perform phase adjustments to bands or subbands, rather than delays in the time domain. In that case, signals 306-1 through 306-P are already in the frequency domain, negating the need for a subsequent Filterbank 401 (FIG. 4, as described below).

Some of the devices or processes such as Calc Delays 301 and Auditory Scene Analysis 103 may look ahead in the audio channels to provide more accurate estimates of event boundaries and time or phase corrections to be applied to within events.[

Mix Channels 206 (FIG. 2)

Figure 4:
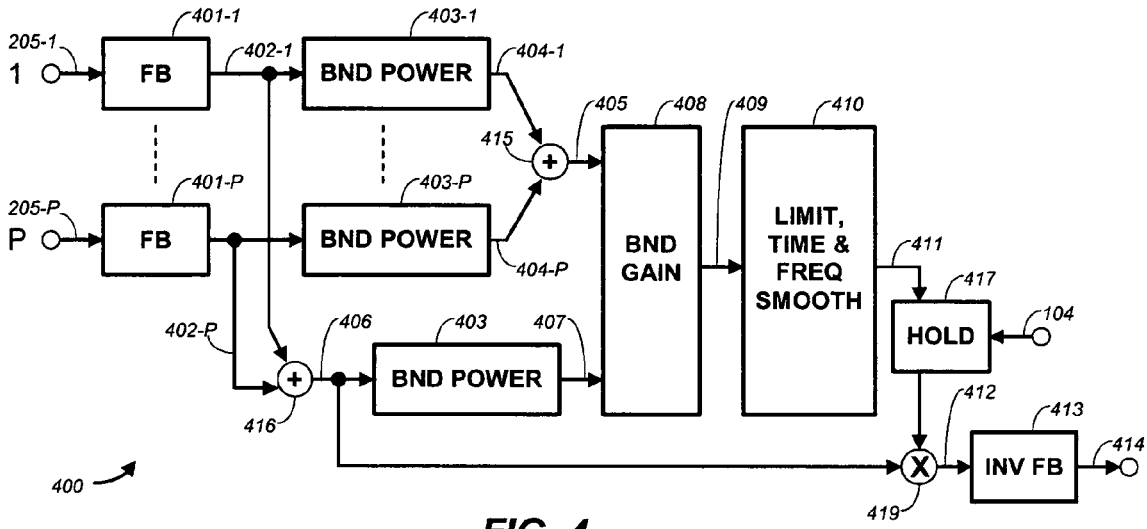
FIG. 4 is a functional schematic block diagram showing the Mix Channels 206 of FIG. 2 in more detail.

Details of the Mix Channels 206 of FIG. 2 are shown as device or process 400 in FIG. 4, which shows how the input channels may be combined, with power correction, to create a downmixed output channel. In addition to mixing or combining the channels, this device or process may correct for residual frequency cancellations that were not completely corrected by Time & Phase Correction 203 in FIG. 2. It also functions to maintain power conservation. In other words, Mix Channels 206 seeks to ensure that the power of the output downmix signal 414 (FIG. 4) is substantially the same as the sum of the power of the time or phase adjusted input channels 205-1 through 205-P. Furthermore, it may seek to ensure that the power in each frequency band of the downmixed signal is substantially the sum of the power of the corresponding frequency bands of the individual time or phase adjusted input channels. The process achieves this by comparing the band power from the downmixed channel to the band powers from the input channels and subsequently calculating a gain correction value for each band. Because changes in gain adjustments across both time and frequency may lead to audible artifacts, the gains preferably are both time and frequency smoothed before being applied to downmixed signal. This device or process represents one possible way of combining channels. Other suitable devices or processes may be employed. The particular combining device or process is not critical to the invention.

Filterbank ("FB") 401-1 through 401-P (FIG. 4)

The input audio signals for each input channel are time-domain signals and may have been divided into overlapping blocks of approximately 10.6 milliseconds in length, overlapping by approximately 5.3 milliseconds, as mentioned above. For an audio sample rate of 48 kHz, this is equivalent to 512 sample blocks of which 256 samples overlaps with the previous block. The sample blocks may be windowed and converted to the frequency domain by Filterbanks 401-1 through 401-P (one filterbank for each input signal). Although any one of various window types may be used, a Hanning window has been found to be suitable. Although any one of various time-domain to frequency-domain converters or conversion processes may be used, a suitable converter or conversion method may use a Discrete Fourier Transform (implemented as a Fast Fourier Transform for speed). The output of each filterbank is a respective array 402-1 through 402-P of complex spectral values—one value for each frequency band (or bin).

Band ("BND") Power 403-1 through 403-P (FIG. 4)

For each channel, a band power calculator or calculating process ("BND Power") 403-1 through 403-P, respectively, computes and calculates the power of the complex spectral values 402-1 through 402-P, and outputs them as respective power spectra 404-1 through 404-P. Power spectrum values from each channel are summed in an additive combiner or combining function 415 to create a new combined power spectrum 405. Corresponding complex spectral values 402-1 through 402-P from each channel are also summed in an additive combiner or combining function 416 to create a downmix complex spectrum 406. The power of downmix complex spectrum 406 is computed in another power calculator or calculating process ("BND Power") 403 and output as the downmix power spectrum 407.

Band ("BND") Gain 408 (FIG. 4)

A band gain calculator or calculating process (Band Gain 408) divides the power spectrum 405 by the downmix power spectrum 407 to create an array of power gains or power ratios, one for each spectral value. If a downmix power spectral value is zero (causing the power gain to be infinite), then the corresponding power gain is set to "1." The square root of the power gains is then calculated to create an array of amplitude gains 409.

Limit, Time & Frequency Smooth 410 (FIG. 4)

A limiter and smoother or limiting and smoothing function (Limit, Time & Frequency Smooth) 410 performs appropriate gain limiting and time/frequency smoothing. The spectral amplitude gains discussed just above may have a wide range. Best results may be obtained if the gains are kept within a limited range. For example, if any gain is greater an upper threshold, it is set equal to the upper threshold. Likewise, for example, if any gain is less than a lower threshold, it is set equal to the lower threshold. Useful thresholds are 0.5 and 2.0 (equivalent to ±6 dB).

The spectral gains may then be temporally smoothed using a first-order infinite impulse response (IIR) filter. The following equation shows the filter computation where b denotes spectral band index, B denotes the total number of bands, n denotes the current block, n−1 denotes the previous block, G denotes the unsmoothed gains and $G_s$ denotes the temporally smooth gains.

$$G_S(b,n)=\delta(b)\times G(b)+(1-\delta(b))\times G_S(b,n-1)\ b=0,\ldots,B-1 \quad (4)$$

A useful value for δ(b) has been found to be 0.5 except for bands below approximately 200 Hz. Below this frequency, δ(b) tends toward a final value of 0 at band b=0 or DC. If the smoothed gains $G_S$ are initialized to 1.0, the value at DC stays equal to 1.0. That is, DC will never be gain adjusted and the gain of bands below 200 Hz will vary more slowly than bands in the rest of the spectrum. This may be useful in preventing audible modulations at lower frequencies. This is because at frequencies lower than 200 Hz, the wavelength of such frequencies approaches or exceeds the block size used by the filterbank, leading to inaccuracies in the filterbanks' ability to accurately discriminate these frequencies. This is a common and well-known phenomenon.

The temporally-smoothed gains are further smoothed across frequency to prevent large changes in gain between adjacent bands. In the preferred implementation, the band gains are smoothed using a sliding five band (or approximately 470 Hz) average. That is, each bin is updated to be the average of itself and two adjacent bands both above and below in frequency. At the upper and lower edge of the spectrum, the edge values (bands 0 and N−1) are used repeatedly so that a five band average can still be performed.

The smoothed band gains are output as signal 411 and multiplied by the downmix complex spectral values in a multiplier or multiplying function 419 to create the corrected downmix complex spectrum 412. Optionally, the output signal 411 may be applied to the multiplier or multiplying function 419 via a temporary memory device or process ("Hold") 417 under control of the ASA information 104. Hold 417 operates in the same manner as Hold 303 of FIG. 3. For example, the gains could be held relatively constant during an event and only changed at event boundaries. In this way, possibly audible and dramatic gain changes during an event may be prevented.

Inverse Filterbank (Inv FB) 413 (FIG. 4)

The downmix spectrum 412 from multiplier or multiplying function 419 is passed through an inverse filterbank or filterbank function ("INV FB") 413 to create blocks of output time samples. This filterbank is the inverse of the input filterbank 401. Adjacent blocks are overlapped with and added to previous blocks, as is well known, to create an output time-domain signal 414.

The arrangements described do not preclude the common practice of separating the window, at the forward filterbank 401, into two windows (one used at the forward and one used at the inverse filterbank) whose multiplication is such that unity signal is maintained through the system.

Downmixing Applications

One application of downmixing according to aspects of the present invention is the playback of 5.1 channel content in a motor vehicle. Motor vehicles may reproduce only four channels of 5.1 channel content, corresponding approximately to the Left, Right, Left Surround and Right Surround channels of such a system. Each channel is directed to one or more loudspeakers located in positions deemed suitable for reproduction of directional information associated with the particular channel. However motor vehicles usually do not have a center loudspeaker position for reproduction of the Center channel in such a 5.1 playback system. To accommodate this situation, it is known to attenuate the Center channel signal (by 3 dB or 6 dB for example) and to combine it with each of the Left and Right channel signals to provide a phantom center channel. However, such simple combining leads to artifacts previously described.

Instead of applying such a simple combining, channel combining or downmixing according to aspects of the present invention may be applied. For example, the arrangement of FIG. 1 or the arrangement of FIG. 2 may be applied twice, once for combining the Left and Center signals, and once for combining Center and Right signals. However, it may still be beneficial to attenuate the Center channel signal by, for example, 3 dB or 6 dB (6 dB may be more appropriate than 3 dB in the near-field space of a motor vehicle interior) before combining it with each of the Left Channel and Right Channels signals so that output acoustical power from the Center channel signal is approximately the same as it would be if presented through a dedicated Center channel speaker. Furthermore, it may be beneficial to denote the Center signal as the reference channel when combining it with each of the Left Channel and Right Channel signals such that the Time & Phase Correction 103 to which the Center channel signal is applied does not alter the time alignment or phase of the Center channel but only alters the time alignment or phase of the Left Channel and the Right Channel signals. Consequently, the Center Channel signal would not be adjusted differently in each of the two summations (i.e., the Left Channel plus Center Channel signals summation and the Right Channel plus Center Channel signals summation), thus ensuring that the phantom Center Channel image remains stable.

The inverse may also be applicable. That is, time or phase adjust only the Center channel, again ensuring that the phantom Center Channel image remains stable.

Another application of the downmixing according to aspects of the present invention is in the playback of multichannel audio in a cinema. Standards under development for the next generation of digital cinema systems require the delivery of up to, and soon to be more than, 16 channels of audio. The majority of installed cinema systems only provide 5.1 playback or "presentation" channels (as is well known, the "0.1" represents the low frequency "effects" channel). Therefore, until the playback systems are upgraded, at significant expense, there is the need to downmix content with more than 5.1 channels to 5.1 channels. Such downmixing or combining of channels leads to artifacts as discussed above.

Therefore, if P channels are to be downmixed to Q channels (where P>Q) then downmixing according to aspects of the present invention (e.g., as in the exemplary embodiments of FIGS. 1 and 2) may be applied to obtain one or more of the Q output channels in which some or all of the output channels are a combination of two or more of respective ones of the P input channels. If an input channel is combined into more than one output channel, it may be advantageous to denote such a channel as a reference channel, such that the Time & Phase Correction 202 in FIG. 2 does not alter the time alignment or phase of such an input channel differently for each output channel into which it is combined.

Alternatives

Time or phase adjustment, as described herein, serves to minimize the complete or partial cancellation of frequencies during downmixing. Previously, it was described that when an input channel is combined into more than one output channel, that this channel preferably is denoted as the reference channel such that it is not time or phase adjusted differently when mixed to multiple output channels. This works well when the other channels do not have content that is substantially the same. However, situations can arise where two or more other channels have content that is the same or substantially the same. If such channels are combined into more than one output channel, when listening to the resulting output channels, the common content is perceived as a phantom image in space in a direction that is somewhere between the physical locations of the loudspeakers receiving those output channels. The problem arises when these two or more input channels, with substantially equivalent content, are independently phase adjusted prior to being combined with other channels to create the output channels. The independent phase adjustment can lead to both incorrect phantom image location, and/or indeterminate image location, both of which may be audibly perceived as unnatural.

It is possible to devise a system that looks for input channels having substantially similar content and attempts to time or phase adjust such channels in the same or similar way such that their phantom image location is not altered. However, such a system becomes very complex, especially as the number of input channels becomes substantially larger than the number of output channels. In systems where substantially similar content frequently occurs in more than one input channel, it may be simpler to dispense with phase adjustment, and perform only power correction.

This adjustment problem can be explained further in the automobile application described previously in which the Center channel signal is combined with each of the Left and Right channels for playback through the Left and Right loudspeakers, respectively. In 5.1 channel material, the Left and Right input channels often contain a plurality of signals (e.g., instruments, vocals, dialog and/or effects), some of which are different and some of which are the same. When the Center channel is mixed with each of the Left and Right channels, the Center channel is denoted as the reference channel and is not time or phase adjusted. The Left channel is time or phase adjusted so as to produce minimal phase cancellation when combined with the Center channel, and similarly the Right channel is time or phase adjusted so as to produce minimal phase cancellation when combined with the Center channel. Because the Left and Right channels are time or phase adjusted independently, signals that are common to the Left and Right channels may no longer have a phantom image between the physical locations of the Left and Right loudspeakers. Furthermore, the phantom image may not be localized to any one direction but may be spread throughout the listening space—an unnatural and undesirable effect.

Figure 6:
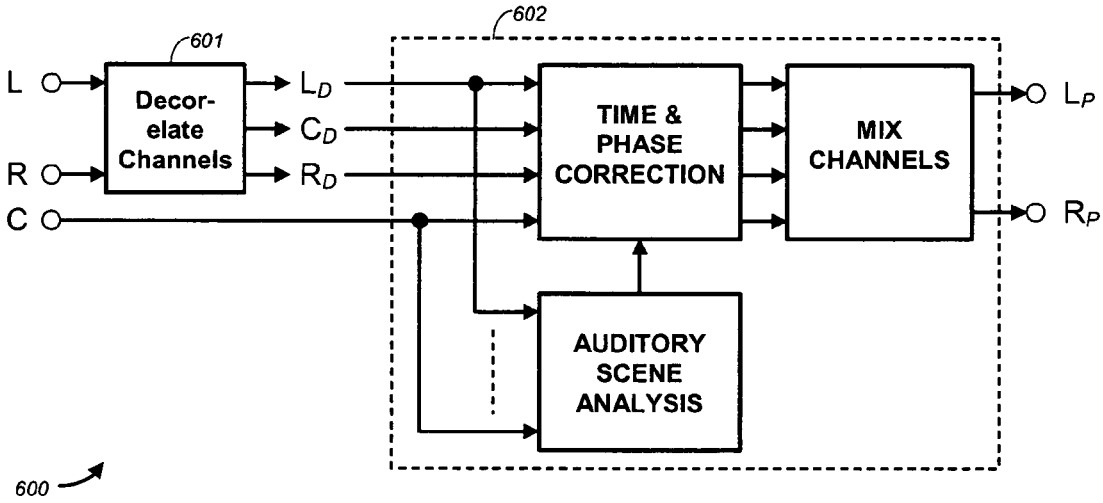
FIG. 6 is a functional schematic block diagram of a three channel to two channel downmix according to aspects of the invention.

A solution to the adjustment problem is to extract signals that are common to more than one input channel from such input channels and place them in new and separate input channels. Although this increases the overall number of input channels P to be downmixed, it reduces spurious and undesirable phantom image distortion in the output downmixed channels. An automotive example device or process 600 is shown in FIG. 6 for the case of three channels being downmixed to two. Signals common to the Left and Right input channels are extracted from the Left and Right channels into another new channel using any suitable channel multiplier or multiplication process ("Decorrelate Channels") 601 such as an active matrix decoder or other type of channel multiplier that extracts common signal components. Such a device may be characterized as a type of decorrelator or decorrelation function. One suitable active matrix decoder, known as Dolby Surround Pro Logic II, is described in U.S. patent application Ser. No. 09/532,711 of James W. Fosgate, filed Mar. 22, 2000, entitled "Method for deriving at least three audio signals from two input audio signals", and U.S. patent application Ser. No. 10/362,786 of James W. Fosgate, et al, filed Feb. 25, 2003, entitled "Method for apparatus for audio matrix decoding," published as U.S. 2004/0125960 A1 on Jul. 1, 2004, which is the U.S. national application resulting from International Application PCT/US01/27006, filed Aug. 30, 2001, designating the United States, published as WO 02/19768 on Mar. 7, 2002. Said Fosgate and Fosgate et al applications are hereby incorporated by reference in their entirety. Another type of suitable channel multiplier and decorrelator that may be employed is described in U.S. patent application Ser. No. 10/467,213 of Mark Franklin Davis, filed Aug. 5, 2003, entitled "Audio Channel Translation," published as U.S. 2004/0062401 A1 on Apr. 1, 2004, which is the U.S. national application resulting from International Application PCT/US02/03619, filed Feb. 7, 2002, designating the United States, published as WO 02/063925 on Aug. 7, 2003, and International Application PCT/US03/24570, filed Aug. 6, 2003, designating the United States, published as WO 2004/019656 on Mar. 4, 2004. Each of said Davis applications is hereby incorporated by reference in its entirety. Another suitable channel multiplication/decorrelation technique is described in "Intelligent Audio Source Separation using Independent Component Analysis," by Mitianoudis and Davies, Audio Engineering Society Convention Paper 5529, Presented at the 112$^{th}$ Convention, May 10-13, 2002, Munich, Germany. Said paper is also hereby incorporated by reference in its entirety. The result is four channels, the new channel $C_D$, the original Center channel C and the modified Left and Right channels, $L_D$ and $R_D$.

The device or process 602, based on the arrangement of FIG. 2, but here with two output channels, combines the four channels to create Left and Right playback channels $L_P$ and $R_P$. The modified channels $L_D$ and $R_D$ are each mixed to only one playback channel; $L_P$ and $R_P$ respectively. Because they do not substantially contain any correlated content, the modified channels $L_D$ and $R_D$, from which their common component $C_D$ has been extracted, can be time or phase adjusted without affecting any phantom center images present in the input channels L and R. To perform the time and/or phase adjustment, one of the channels such as channel $C_D$ is denoted as the reference channel. The other channels $L_D$, $R_D$ and C are then time and/or phase adjusted relative to the reference channel. Alternatively since the $L_D$ and $R_D$ channels are unlikely to be correlated with the C channel, and since they are decorrelated from the $C_D$ channel by means of process 601, they may be passed to mix channels without any time or phase adjustment. Both original channel C and the derived center channel $C_D$ may be mixed with each of the intermediate channels $L_D$ and $R_D$, respectively, in the Mix Channels portion of device or process 602 to produce the playback channels $L_P$ and $R_P$. Although an equal proportion of C and $C_D$ has been found to produce satisfactory results, the exact proportion is not critical and may be other than equal. Consequently, any time and phase adjustment applied to $C_D$ and C will appear in both playback channels, thus maintaining the direction of phantom center images. Some attenuation (for example 3 dB) may be required on each of the center channels since these channels are reproduced through two speakers, and not one. Also the amount of each of the center channels C and $C_D$ that is mixed into the output channels could be controlled by the listener. For example the listener may desire all of the original center channel C but some attenuation on the derived center channel $C_D$.

Figure 7A:
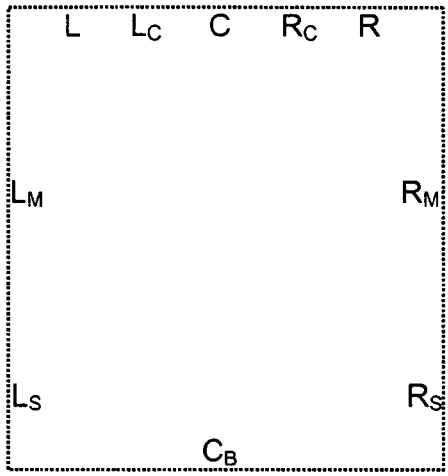
FIGS. 7*a* and 7*b* are idealized representations showing the spatial locations of two sets of audio channels in a room, such as a cinema auditorium.
Figure 7B:
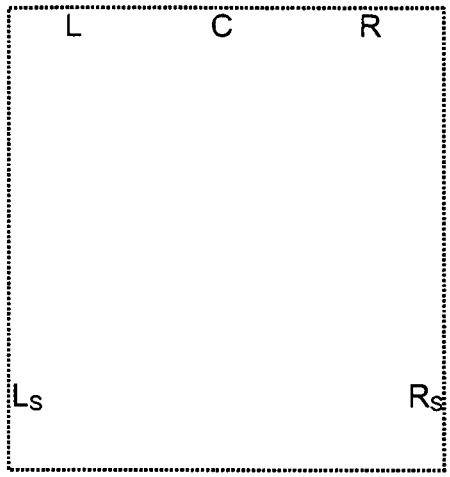

The solution may also be explained by way of an example in cinema audio. FIGS. 7*a* and 7*b* show the room or spatial locations of two sets of audio channels. FIG. 7*a* shows the approximate spatial locations of the channels as presented in the multichannel audio signal, otherwise denoted as "content channels". FIG. 7*b* shows the approximate locations of channels, denoted as "playback channels," that can be reproduced in a cinema that is equipped to play five channel audio material. Some of the content channels have corresponding playback channel locations; namely, the L, C. R, $R_S$ and $L_S$ channels. Other content channels do not have corresponding playback channel locations and therefore must be mixed into one or more of the playback channels. A typical approach is to combine such content channels into the nearest two playback channels.

As previously mentioned, simple additive combining may lead to audible artifacts. As also mentioned, combining as described in connection with FIGS. 1 and 2 may also lead to phantom imaging artifacts when channels that have substantially common content are phase or time adjusted differently. A solution includes extracting signals that are common to more than one input channel from such input channels and place them in new and separate channels.

Figure 7C:
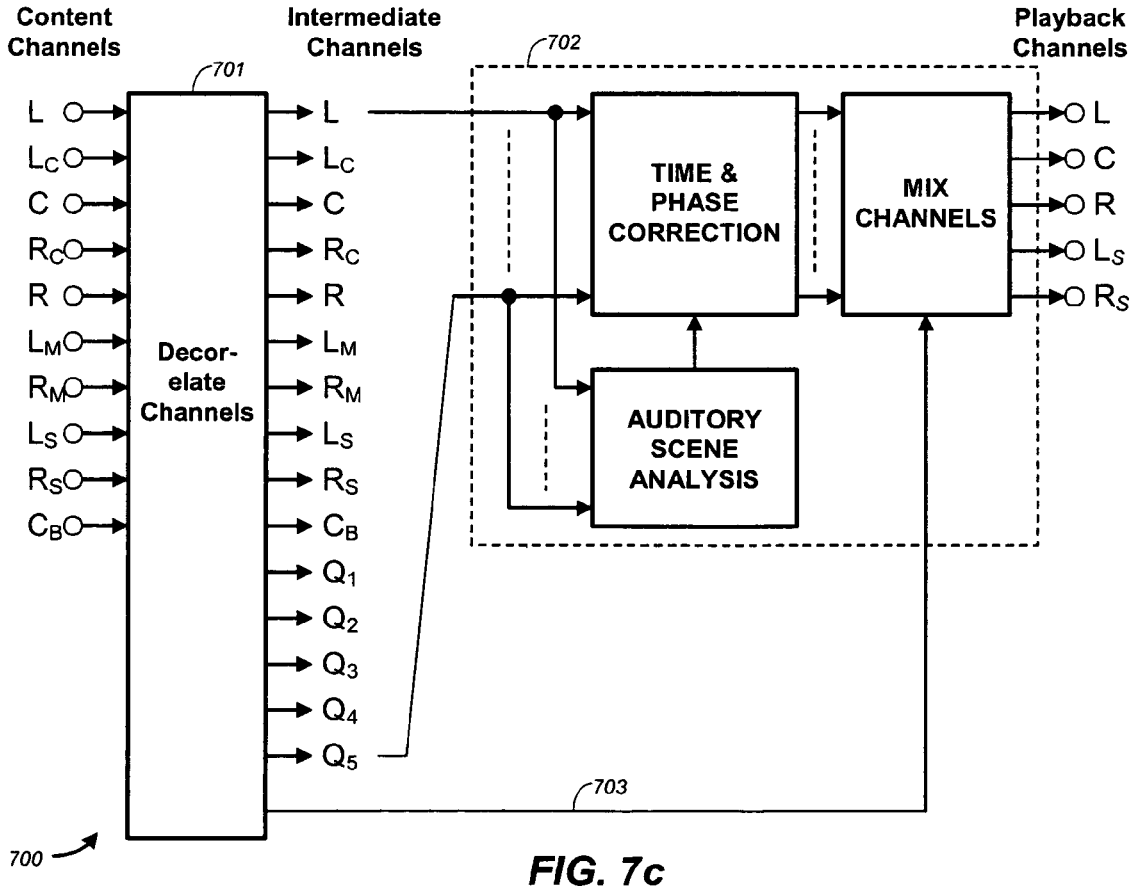
FIG. 7*c* is a functional schematic block diagram of a ten channel to five channel downmix according to aspects of the invention

FIG. 7*c* shows a device or process 700 for the case in which five additional channels $Q_1$ to $Q_5$ are created by extracting information common to some combinations of the input or content channels using device or process ("Decorrelate Channels") 701. Device or process 701 may employ a suitable channel multiplication/decorrelation technique such as described above for use in the "Decorrelate Channels" device or function 601. The actual number and spatial location of these additional intermediate channels may vary according to variations in the audio signals contained in the content channels. The device or process 702, based on the arrangement of FIG. 2, but here with five output channels, combines the intermediate channels from Decorrelate Channels 701 to create the five playback channels.

For time and phase correction, one of the intermediate channels such as the C channel, may be denoted as the reference channel and all other intermediate channels be time and phase adjusted relative to this reference. Alternatively, it may be beneficial to denote more than one of the channels as reference channels and thus perform time or phase corrections in smaller groups of channels than the total number of intermediate channels. For example if channel $Q_1$ represents common signals extracted out of content channels L and C, and if $Q_1$ and $L_C$ are being combined with intermediate channels L and C to create the playback channels L and C, channel $L_C$ may be denoted as the reference channel. Intermediate channels L, C and $Q_1$ are then time or phase adjusted relative to the reference intermediate channel $L_C$. Each smaller group of intermediate channels is time or phase adjusted in succession until all intermediate channels have been considered by the time and phase correction process.

In creating the playback channels, device or process 702 may assume a priori knowledge of the spatial locations of the content channels. Information regarding the number and spatial location of the additional intermediate channels may be assumed or may be passed to the device or process 702 from the decorrelating device or process 701 via path 703. This enables process or device 702 to combine the additional intermediate channels into, for example, the nearest two playback channels so that phantom image direction of these additional channels is maintained.

Implementation

The invention may be implemented in hardware or software, or a combination of both (e.g., programmable logic arrays). Unless otherwise specified, the algorithms included as part of the invention are not inherently related to any particular computer or other apparatus. In particular, various general-purpose machines may be used with programs written in accordance with the teachings herein, or it may be more convenient to construct more specialized apparatus (e.g., integrated circuits) to perform the required method steps. Thus, the invention may be implemented in one or more computer programs executing on one or more programmable computer systems each comprising at least one processor, at least one data storage system (including volatile and non-volatile memory and/or storage elements), at least one input device or port, and at least one output device or port. Program code is applied to input data to perform the functions described herein and generate output information. The output information is applied to one or more output devices, in known fashion.

Each such program may be implemented in any desired computer language (including machine, assembly, or high level procedural, logical, or object oriented programming languages) to communicate with a computer system. In any case, the language may be a compiled or interpreted language.

Each such computer program is preferably stored on or downloaded to a storage media or device (e.g., solid state memory or media, or magnetic or optical media) readable by a general or special purpose programmable computer, for configuring and operating the computer when the storage media or device is read by the computer system to perform the procedures described herein. The inventive system may also be considered to be implemented as a computer-readable storage medium, configured with a computer program, where the storage medium so configured causes a computer system to operate in a specific and predefined manner to perform the functions described herein.

A number of embodiments of the invention have been described. Nevertheless, it will be understood that various modifications may be made without departing from the spirit and scope of the invention. For example, some of the steps described above may be order independent, and thus can be performed in an order different from that described. Accordingly, other embodiments are within the scope of the following claims.

I claim:

1. A process for combining audio channels, comprising combining the audio channels to produce a combined audio channel, and dynamically applying one or more of time, phase, and amplitude or power adjustments to the channels, to the combined channel, or to both the channels and the combined channel, wherein one or more of said adjustments are controlled at least in part by a measure of auditory events in one or more of the channels and/or the combined channel so that the adjustments remain substantially constant during auditory events and are allowed to change at or near auditory event boundaries, wherein each auditory event boundary is identified in response to a change in signal characteristics with respect to time in a channel exceeding a threshold such that a set of auditory event boundaries is obtained for the channel, wherein an audio segment in the channel between consecutive boundaries constitutes an auditory event.

2. A process for downmixing P audio channels to Q audio channels, where P is greater than Q, wherein at least one of the Q audio channels is obtained by the process of claim 1.

3. A process according to claim 1 wherein said signal characteristics are one of: (a) spectral content, or (b) spectral content and amplitude content.

4. A process according to claim 3 wherein identifying auditory event boundaries in a channel includes dividing the audio signal into time blocks, converting the data in each block to the frequency domain, and detecting changes in (a) spectral content or (b) spectral content and amplitude content between successive time blocks of the audio signal in the channel.

5. A process according to claim 4 wherein the audio data in consecutive time blocks is represented by coefficients and identifying auditory event boundaries in a channel includes comparing coefficients of a block to corresponding coefficients of an adjacent block.

6. A process according to claim 5 wherein a single difference measure is calculated by summing the absolute value of the difference in logarithmically-expressed corresponding spectral values of the current and next previous block spectrums and comparing the single difference measure to a threshold.

7. A process according to claim 6 wherein an auditory event boundary is identified when the summed magnitudes exceed said threshold.

8. A process for downmixing three input audio channels α, β, and δ to two output audio channels α" and δ", wherein the three input audio channels represent, in order, consecutive spatial directions α, β, and δ, and the two output channels α" and δ" represent the non-consecutive spatial directions α and δ, comprising extracting common signal components from the two input audio channels representing directions α and δ to produce three intermediate channels:

channel α', a modification of channel α representing the direction α, channel α' comprising the signal components of channel α from which signal components common to input channels α and δ have been substantially removed, channel δ', a modification of channel δ representing the direction δ, channel δ' comprising the signal components of channel δ from which signal components common to input channels α and δ have been substantially removed, and channel β', a new channel representing the direction β, channel β' comprising the signal components common to input channels α and δ, combining intermediate channel α', intermediate channel β', and input channel β to produce output channel α", and combining intermediate channel δ', intermediate channel β', and input channel β to produce output channel δ".

9. A process according to claim 8 further comprising dynamically applying one or more of time, phase, and amplitude or power adjustments to one or more of the intermediate channels α', β', and δ' and the input channel β, and/or one or both of the combined output channels α" and δ".

10. A process according to claim 9 wherein one or more of said adjustments are controlled at least in part by a measure of auditory events in one or more channels of the input channels, the intermediate channels, and/or the combined output channels channel so that the adjustments remain substantially constant during auditory events and are allowed to change at or near auditory event boundaries, wherein each auditory event boundary is identified in response to a change in signal characteristics with respect to time in a channel exceeding a threshold such that a set of auditory event boundaries is obtained for the channel, wherein an audio segment in the channel between consecutive boundaries constitutes an auditory event.

11. A process according to claim 8 wherein the consecutive spatial directions α, β, and δ are one of the sets of directions:

left, center, and right, left, left center, and center, center, right center, and right, right, right middle, and right surround, right surround, center back, and left surround, and left surround, left middle, and left.

12. Apparatus adapted to perform the methods of any one of claims 1, 8 and 10.

13. A computer program, stored on a computer-readable medium for causing a computer to perform the methods of any one of claims 1, 8 and 10.

14. A process according to claim 10 wherein said signal characteristics are one of: (a) spectral content, or (b) spectral content and amplitude content.

15. A process according to claim 14 wherein identifying auditory event boundaries in a channel includes dividing the audio signal into time blocks, converting the data in each block to the frequency domain, and detecting changes in (a) spectral content or (b) spectral content and amplitude content between successive time blocks of the audio signal in the channel.

16. A process according to claim 15 wherein the audio data in consecutive time blocks is represented by coefficients and identifying auditory event boundaries in a channel includes comparing coefficients of a block to corresponding coefficients of an adjacent block.

17. A process according to claim 16 wherein a single difference measure is calculated by summing the absolute value of the difference in logarithmically-expressed corresponding spectral values of the current and next previous block spectrums and comparing the single difference measure to a threshold.

18. A process according to claim 17 wherein an auditory event boundary is identified when the summed magnitudes exceed said threshold.

* * * * *